US005432991A

United States Patent [19]

Godleski

[11] Patent Number: 5,432,991

[45] Date of Patent: Jul. 18, 1995

[54] METHOD OF MAKING A DISPLAY

[76] Inventor: Peter J. Godleski, 7917 N. Marbella Ct., Orlando, Fla. 32819

[21] Appl. No.: 980,200

[22] Filed: Nov. 23, 1992

Related U.S. Application Data

[62] Division of Ser. No. 604,803, Oct. 26, 1990, abandoned.

[51] Int. Cl.[6] ..... G09F 9/00; A63H 3/02; A63H 33/00

[52] U.S. Cl. ..... 29/460; 29/463; 29/469.5; 29/527.1; 29/527.2; 29/527.4; 156/228; 264/339; 446/370; 446/26; 116/306

[58] Field of Search ..... 40/586, 584; 5/437, 5/448, 440, 442, 481; 446/26, 181, 390, 374, 370, 73, 382; 297/181; 116/306, 307; D6/599, 598, 359; 29/460, 463, 469.5, 527.1, 527.2, 527.4; 156/228; 264/339

[56] References Cited

U.S. PATENT DOCUMENTS

| | | | |
|---|---|---|---|
| 2,109,422 | 2/1938 | Haughton | 446/374 |
| 2,134,974 | 11/1938 | Hurwitz | 446/374 X |
| 2,405,484 | 8/1946 | Baiche | 5/448 |
| 3,445,917 | 5/1969 | Adler | 29/463 |
| 4,455,963 | 6/1984 | Matsuo | 446/26 X |

*Primary Examiner*—Joseph M. Gorski
*Attorney, Agent, or Firm*—William M. Hobby, III

[57] ABSTRACT

A display and seat cushion for use at arenas, stadiums, and the like, has a generally hand-shaped foam polymer member having a plurality of finger portions thereon and a ductile frame extending through the foam polymer member plurality of finger portions so that the foam finger portions can be shaped as desired. A fabric covering covers the foam polymer member and a glove compartment is formed in the foam polymer member for hand holding the display. The foam polymer member is shaped and sized to act as a stadium cushion as well as a hand-held display having changeable, positionable finger portions. The method of making a display and seat cushion includes forming a pair of generally hand shaped foam polymer members having a plurality of finger portions and forming a ductile frame shaped to fit between the pair of hand shaped foam members such that the ductile frame extends into each finger portion and then adhesively attaching the pair of generally hand shaped foam members together while attaching the ductile frame therebetween and then covering the attached pair of foam members with a fabric so that a hand shaped stadium cushion and display is formed with ductile finger portions.

2 Claims, 1 Drawing Sheet

METHOD OF MAKING A DISPLAY

This is a division of application Ser. No. 07,604,803, filed Oct. 26, 1990, now abandoned.

BACKGROUND OF THE INVENTION

The present invention relates to a display apparatus and method and especially to a hand held display and seat cushion shaped like a large hand.

In the past a large variety of displays have been provided including a wide variety of hand held displays including paddle shaped hand held displays having stop signs thereon or the like for use in traffic control as well as a variety of hand held displays which are also stadium cushions. A few displays also include a generally hand shape. For instance, the Love, et al. U.S. Pat. No. 4,637,151, is a combination stadium cushion and pendant which is illustrated in connection with a printed hand shape which allows a finger to protrude but which also act as a stadium cushion and may include a removable name slot. In the Breault design patent, U.S. Pat. No. D 295,640, a set of hand signals is provided with a variety of rigid hand designs attached to an extendable support. In the Owensmith U.S. Pat. No. 4,037,340, a scarf is provided which can be worn around the neck in the usual manner but can be held stretched out to act as a hand held display for readable matter. In the design patent to Ehrlich for a signal, #D 234,583, a hand shaped signal has a thumb which can be folded in and out on a supporting hinge. In the design patent to Rigsby, #D 214,855, a wire hand for a mannequin is illustrated.

In contrast to these prior patents, the present invention provides a hand held display of a large generally hand shape having a glove-like support portion in the palm of the hand shape which is large enough and shaped to act as a stadium cushion but which has a ductile frame formed in a flexible foam body so as to readily change the shape of the fingers of the hand, such as to indicate #1, thumbs up, or the like.

SUMMARY OF THE INVENTION

A display and seat cushion for use at arenas, stadiums and the like has a generally hand-shaped foam polymer member having a plurality of finger portions thereon and a ductile frame extending through the foam polymer member plurality of finger portions so that the foam finger portions can be shaped as desired. A fabric covering covers the foam polymer member and a glove compartment is formed in the foam polymer member for hand holding the display. The foam polymer member is shaped and sized to act as a stadium cushion as well as a hand-held display having changeable, positionable finger portions. The method of making a display and seat cushion includes forming a pair of generally hand shaped foam polymer members having a plurality of finger portions and forming a ductile frame shaped to fit between the pair of hand shaped foam members such that the ductile frame extends into each finger portion and then adhesively attaching the pair of generally hand shaped foam members together while attaching the ductile frame therebetween. A portion of the foamed polymer members are left for insertion of a person's hand and a fabric covering is attached over the pair of generally hand shaped foam members so that a hand shaped stadium cushion and display can have the finger portions shaped by bending the ductile frame between the foam portions and can be shaped and used as a seat cushion and supported with a hand inserted in the glove portion. The ductile frame is formed with an endless wire frame looped into each finger to avoid protruding sharp edges.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
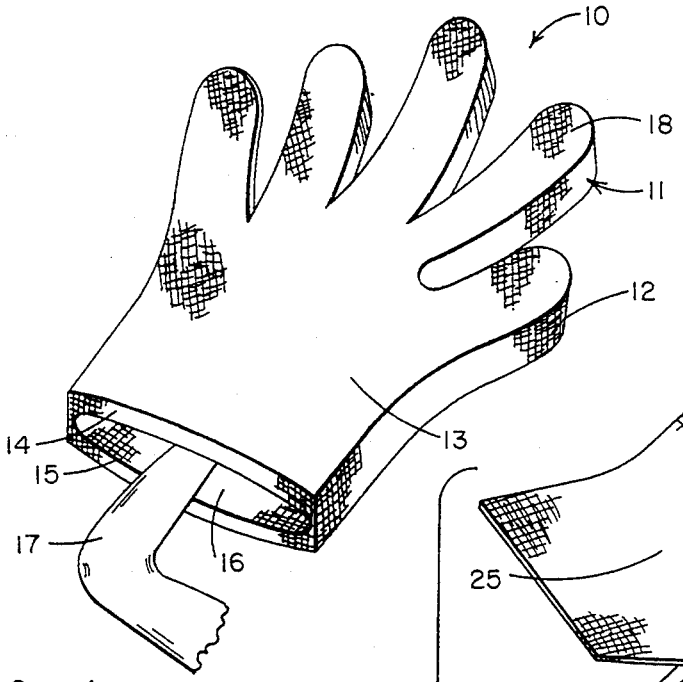
FIG. 1 is a perspective view of a hand held display in accordance with the present invention being supported by an individual's hand.
Figure 2:
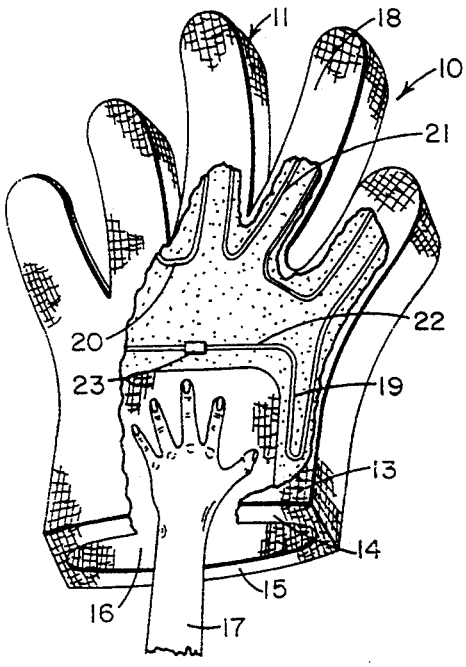
FIG. 2 is a cutaway perspective of the hand held display of FIG. 1.

Referring to the drawings and especially to FIGS. 1 and 2, a hand held display and seat cushion 10 is illustrated having a plurality of finger portions 11 and a thumb portion 12 and body portion or palm 13 of a hand. The hand shape, as shown in FIGS. 1 and 2, is formed of large hand shaped foam polymer members 14 and 15 which have been adhesively attached together leaving a glove or hand inserted space portion 16 for inserting a person's hand 17. The entire hand is covered with a fabric 18 which may be of a fluorescent or brightly colored fabric to draw attention to the hand. The hand may be of thick polystyrafoam or polyurethane foam, such as two inches thick, and sufficiently large to act as a stadium or arena cushion and is generally shaped to allow a person to comfortable sit thereon while cushioning the seat with the foam portions. The hand shaped foam polymer portion has a ductile frame 20 formed between the pair of foam portions 14 and 15 which frame portion is an endless piece of wire having a looped portion 21 extending into each finger portion 18 and a pair of looped extension portions 19 extend along the edge of the palm portion and a palm bracing portion 22 brings the two ends of the ductile wire together and are bound with a strap or band 23. The looped portions 19 give the palm portion more rigidity. The wire frame can, for instance, be of aluminum, copper, or even a ductile steel wire. The looped ends 24 are placed between the foam portions 14 and 15. No sharp protruding edges are in a position to protrude from the foam which is further supported by all of the loops 20 being interconnected with the palm portion 22 so that the entire ductile frame 20 needs to shift in order for any member to shift and thus making it unlikely that the frame would work its way from the foam. The looped end portions 24 are prevented from protruding from the hand by the fabric 18 which would block the blunt ends 24. The hand is such that an individual can place his hand in the glove portion 16 and wave the enlarged brightly colored hand to indicate support for a team in an arena or stadium in which a sporting event is taking place. In addition, the ductile frame 20 placed in the middle of the hand portion in each finger portion allows the fingers to be bent to different shapes by bending the ductile frame 20 finger portions 21 or the thumb portion 12 so that the hand can indicate, for instance, thumbs up or #1 or "V" for victory, or the like. The ductile frame allows the hand to then be reshaped to a flat surface for using as a cushion seat.

Figure 3:
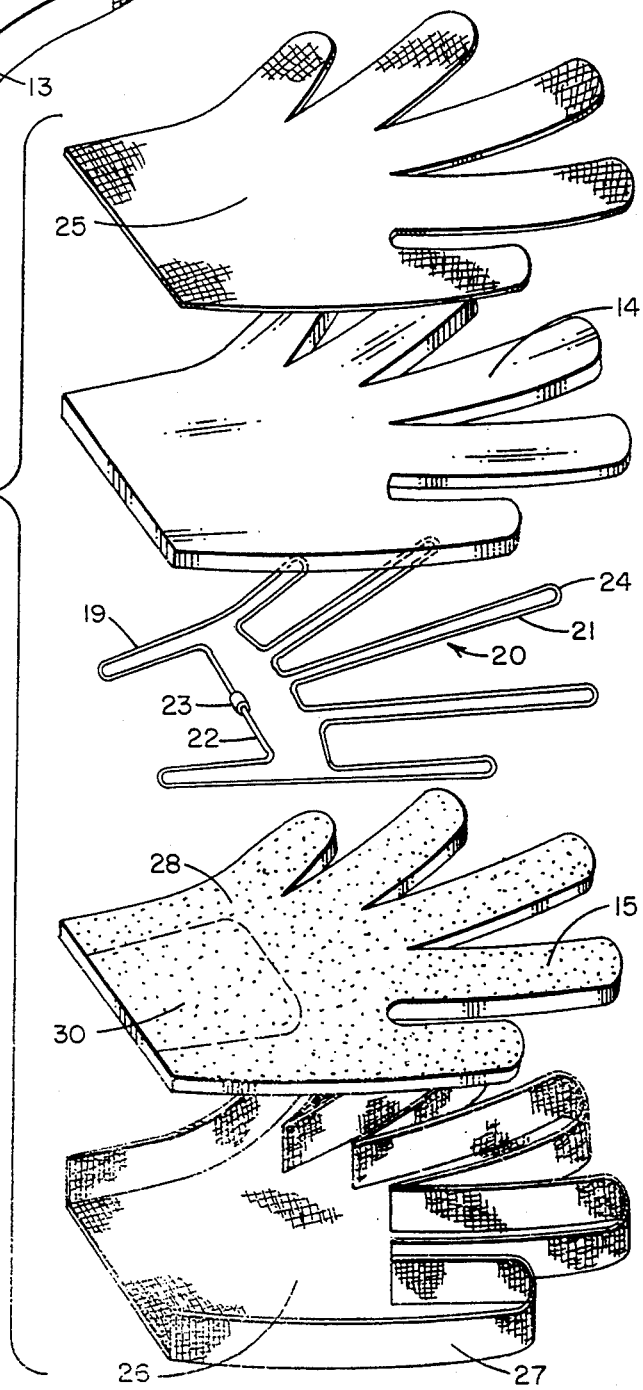
FIG. 3 is an exploded perspective view of the display of FIGS. 1 and 2 illustrating the method of making the hand held display.

Turning now to FIG. 3, a method of making the hand of FIGS. 1 and 2 is more clearly illustrated having a top fabric portion 25 and a bottom fabric portion 26 having edge fabric portions 27 sewn thereto. The bottom hand shaped foam polymer member 15 is shown on one side of the ductile frame 20 while the second generally hand shaped foam member 14 is shown on the opposite side thereof. Each may have an adhesive coating 28 on the one surface thereof. The ductile frame 20 has been formed by looping a single ductile wire member as shown in the Figure with individual finger loops 21 having blunted looped ends 24 and a palm connecting portion 22 which has been strapped with a strap 23. The ductile member is formed on a jig and is rapidly formed to the shape and can be placed between the member 14 or 15 in the proper position with each finger member extending into each finger 18 and the other foam member 14 or 15 placed thereover to adhesively attach the two foam members 14 and 15 together over the ductile frame 20. No adhesive is applied to the palm portion 30 as indicated by the dashed lines which later forms the glove or hand holding insert 16 of the display 10.

Once the foam members are attached over the frame and the fabric members 25 and 26 are attached together with fabric edge members 27, the hand held display in accordance with FIGS. 1 and 2 is formed and can be packaged for sale or shipment. The fabric covering 18 can be formed in a generally hand shaped portions precisely shaped to fit over the foam and in three sections 25, 26 and 27 can be sewn together to form a generally hand shaped section over the foamed members 14 and 15 which are adhesively attached over the ductile frame 20. The fabric can be of any flexible material desired, such as a cotton or synthetic fiber, such as nylon, while the foam polymer members 14 and 15 can be of a foamed polymer urethane or other polymer as desired and the ductile frame 20 can be of a soft ductile metal wire, such as copper or aluminum or can be formed of a soft steel wire.

The ductile frame 20 is shaped in a continuous wire loop having the ends strapped or bound together so as to avoid any sharp edges which might protrude from the display and hurt someone. Having one continuous ductile member prevents one finger portion shifting without the entire unit shifting and a fabric covering 18 prevents the blunt ends from protruding therethrough as could happen in the case of a single wire extending into a finger, for instance.

The process can be altered by replacing the fabric covering material with a polymer dipped covering. Once the foamed members 14 and 15 are attached over the ductile frame 20, the foamed members are dipped in a liquid polymer, such as a vinyl dip, and then curing the coating to form a covering of a flexible polymer material.

It should be clear at this point that a hand display and stadium arena cushion has been provided which can be easily shaped to a variety of shapes. However, it should also be clear that the present invention should not be construed as limited to the forms shown which are to be considered illustrative rather than restrictive.

I claim:

1. A method of making a display and seat cushion comprising the steps of:

forming a pair of generally hand shaped foamed members having a plurality of finger portions;

forming a ductile frame shaped to fit between said pair of hand shaped foamed members, said forming of a ductile frame including forming an endless wire frame shaped to loop into each finger of said hand shaped foamed polymer;

adhesively attaching part of said pair of generally hand shaped foam members together while leaving a portion thereof unattached and attaching said ductile frame therebetween; and covering said attached pair of generally hand shaped foamed members with a flexible material, whereby a hand shaped stadium cushion and display can have a finger portion shaped by bending said ductile frame between said foamed portions.

2. A method of making a display and seat cushion in accordance with claim 1 in which the step of covering said attached pair of generally hand shaped foamed members includes dipping said hand shaped foamed members in a liquid polymer and curing said liquid polymer on said foamed members to form a flexible polymer cover.

* * * * *